US009794704B2

(12) United States Patent
Djalilian et al.

(10) Patent No.: US 9,794,704 B2
(45) Date of Patent: Oct. 17, 2017

(54) DIRECT-DRIVE ACOUSTIC AMPLIFICATION USING A TYMPANOSTOMY TUBE

(71) Applicant: The Regents of the University of California, Oakland, CA (US)

(72) Inventors: Hamid Djalilian, Orange, CA (US); Mark Bachman, Irvine, CA (US); Peyton Paulick, Irvine, CA (US); Mark Merlo, Irvine, CA (US)

(73) Assignee: The Regents of the University of California, Oakland, CA (US)

( * ) Notice: Subject to any disclaimer, the term of this patent is extended or adjusted under 35 U.S.C. 154(b) by 125 days.

(21) Appl. No.: 14/500,882

(22) Filed: Sep. 29, 2014

(65) Prior Publication Data

US 2015/0094523 A1 Apr. 2, 2015

Related U.S. Application Data

(60) Provisional application No. 61/884,821, filed on Sep. 30, 2013.

(51) Int. Cl.
*H04R 25/00* (2006.01)

(52) U.S. Cl.
CPC ..... *H04R 25/606* (2013.01)

(58) Field of Classification Search
CPC ..... A61F 2002/183; H04R 2225/023; H04R 2225/67; H04R 25/456; H04R 25/606
See application file for complete search history.

(56) References Cited

U.S. PATENT DOCUMENTS 6,940,989 B1 * 9/2005 Shennib ..... H04R 25/606 381/326
2007/0154030 A1 * 7/2007 Moses ..... H04R 25/606 381/72

* cited by examiner

*Primary Examiner* — Christine H Matthews
*Assistant Examiner* — Joshua D Lannu
(74) *Attorney, Agent, or Firm* — Troutman Sanders LLP

(57) ABSTRACT

A hearing aid apparatus is provided. In one embodiment, a system and method are provided for using a tympanostomy tube as a platform for driving the middle ear. The system and method may employ a mechanical interface for driving the middle ear. In another embodiment, a hearing aid apparatus includes a direct-drive hearing device (DHD) having a silicone mold on one end, where the silicone mold has an attached magnet; and a tympanostomy tube with a ferromagnetic cap, where the tympanostomy tube is insertable into a tympanic membrane. The DHD is configured for insertion in an ear canal such that the magnet attached to the silicone mold is in contact with the ferromagnetic cap of the tympanostomy tube.

6 Claims, 5 Drawing Sheets

DIRECT-DRIVE ACOUSTIC AMPLIFICATION USING A TYMPANOSTOMY TUBE

PRIORITY

This application claims priority to U.S. Provisional Application No. 61/884,821 filed on Sep. 30, 2013 and titled Direct-Drive Acoustic Amplification Using a Tympanostomy Tube, the disclosure of which is hereby incorporated by reference in its entirety.

BACKGROUND

Non-invasive hearing technologies have inherent problems, including occlusion, feedback, and low satisfaction rates with sound quality and aesthetics. Middle ear implants and cochlear implants can provide acceptable sound quality. However, drawbacks of these types of devices include high cost and the requirement for invasive surgery.

SUMMARY

The disclosed subject matter is directed to a hearing aid apparatus. According to one embodiment, a system and method are provided for using a tympanostomy tube as a platform for driving the middle ear. In one embodiment a hearing aid apparatus includes a direct-drive hearing device (DHD) having a silicone mold on one end, the silicone mold having an attached driver, and a tympanostomy tube insertable into a tympanic membrane, wherein the DHD is placeable inside an ear canal such that the driver is in contact with the tympanostomy tube. The tympanostomy tube provides a mechanical interface with the middle ear. The system and method may employ a mechanical interface for driving the middle ear. In other embodiments, the interface for driving the middle ear may be provided as a platform for coupling.

In one embodiment, the hearing aid device is a direct-drive hearing device (DHD) having a silicone mold on one end, where the silicone mold has an attached magnet; and a tympanostomy tube with a ferromagnetic cap, and where the tympanostomy tube is insertable into a tympanic membrane. The DHD is configured for insertion into an ear canal such that the magnet attached to the silicone mold is in contact with the ferromagnetic cap of the tympanostomy tube. The magnet of the DHD can lock with the ferromagnetic cap and establish a stable connection for mechanical actuation of the tympanic membrane. The tympanostomy tube with the ferromagnetic cap can transmit the driving force of the DHD onto the middle ear ossicles.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

Certain features of the subject technology are set forth in the appended claims. However, for purpose of explanation, several aspects of the subject technology are set forth in the following figures.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology.

However, the subject technology is not limited to the specific details set forth herein and may be practiced without these specific details. In some instances, structures and components are shown in block diagram form in order to avoid obscuring the concepts of the subject technology.

One aspect of the disclosure relates to a Direct-Drive Hearing Device (DHD). The DHD is a hearing aid device that has been developed to combine the advantages of Completely-in-the-Canal (CIC) hearing aids with those of the middle ear implants (MEIs). In one embodiment, the device sits inside the ear canal and mechanically drives the tympanic membrane (TM) and in this matter operates similar to MEIs. The device-TM interface is critical. For this interface, direct-drive and actuation may be provided through a glued magnet. Tympanostomy tubes are frequently used in otolaryngology and their safety is well proven. In the current study, we used a tympanostomy tube as the basis for the device-TM interface and sought to determine whether a tube with a ferromagnetic cap could be actuated to deliver sound to the cochlea.

Figure 1:
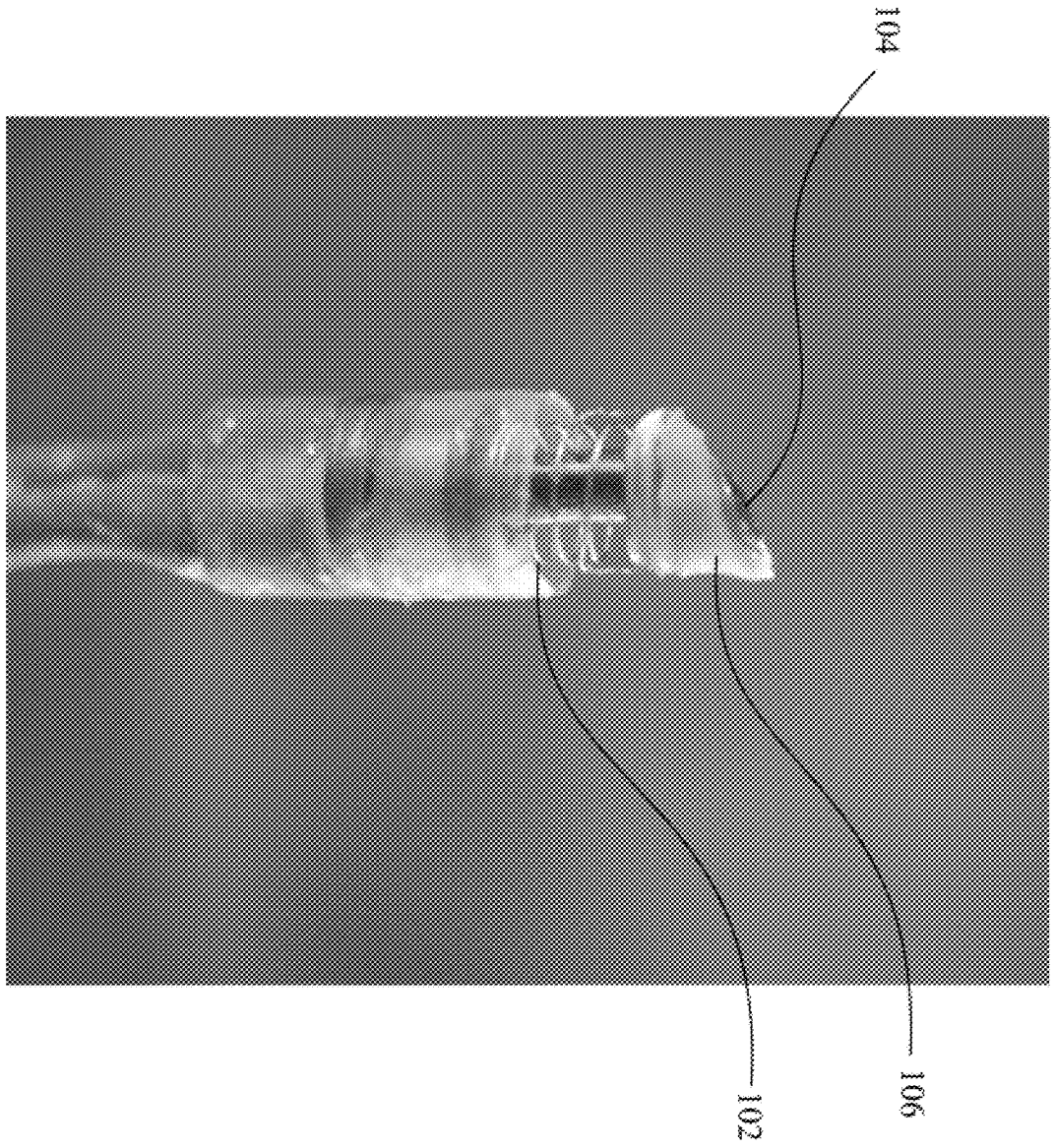
FIG. 1 illustrates a Direct-Drive Hearing Device (DHD) with a small magnet glued to a silicone mold of the tympanic membrane according to one or more embodiments.

FIG. 1 illustrates an example of a small magnet glued to a silicone mold of the tympanic membrane attached to a DHD. The DHD may be a CIC hearing aid that operates by mechanically driving the TM and ossicles similar to MEIs.

DHD 102 may be provided for using a tympanostomy tube as a platform for driving the middle ear. In one embodiment a hearing aid apparatus includes a DHD 102 having a silicone mold on one end, the silicone mold having an attached driver, and a tympanostomy tube insertable into a tympanic membrane, wherein the DHD 102 is placeable inside an ear canal such that the driver is in contact with the tympanostomy tube. The tympanostomy tube provides a mechanical interface with the middle ear. The system and method may employ a mechanical interface for driving the middle ear. In other embodiments, the interface for driving the middle ear may be provided as a platform for coupling. The coupling may be configured for a direct hearing device (DHD) or other similar technologies used to drive the middle ear from ear canal while coupling to the tympanic membrane. Providing a platform of the t-tube as a mechanism for coupling to the tympanic membrane and middle ear system can facilitate sound transmission through mechanical vibration.

A DHD according to one or more embodiments may be provided based on the following determination. In particular, a determination whether a tympanostomy tube with a ferromagnetic cap could be actuated to displace stapes. A ferromagnetic pellet was glued to the outer flange of an Armstrong V Grommet. The tube was then placed into the tympanic membrane of a cadaveric temporal bone. The Direct-Drive Hearing Device (DHD), a completely-in-the-canal hearing aid prototype with a magnet tip, was coupled to the tube. The range of displacements induced by the device was compared to those of sound. A 200 mV input to the device produced a range of displacements equivalent to those of sound at 70 dB sound pressure level (SPL) (mean 0.44 nm; range 0.01-2.80). A 400 mV input produced range of displacements equivalent to those of sound at 80 dB SPL (mean 1.34 nm; range 0.02-8.87). The device was capable of actuating the eardrum through a ferromagnetic tympanostomy tube and producing range of displacements equivalent to moderate-to-severe levels of hearing loss.

In one embodiment the DHD is 6.2×3.7 mm, which does not include the battery or digital signal processing unit. The DHD device underwent bench testing with validation of frequency response and noise generation. A formalin-treated cadaveric temporal bone with an intact ossicular chain (right ear, 8 years post-mortem) was obtained from the willed body program. The middle ear was accessed through a simple mastoidectomy with facial recess approach.

Figure 2A:
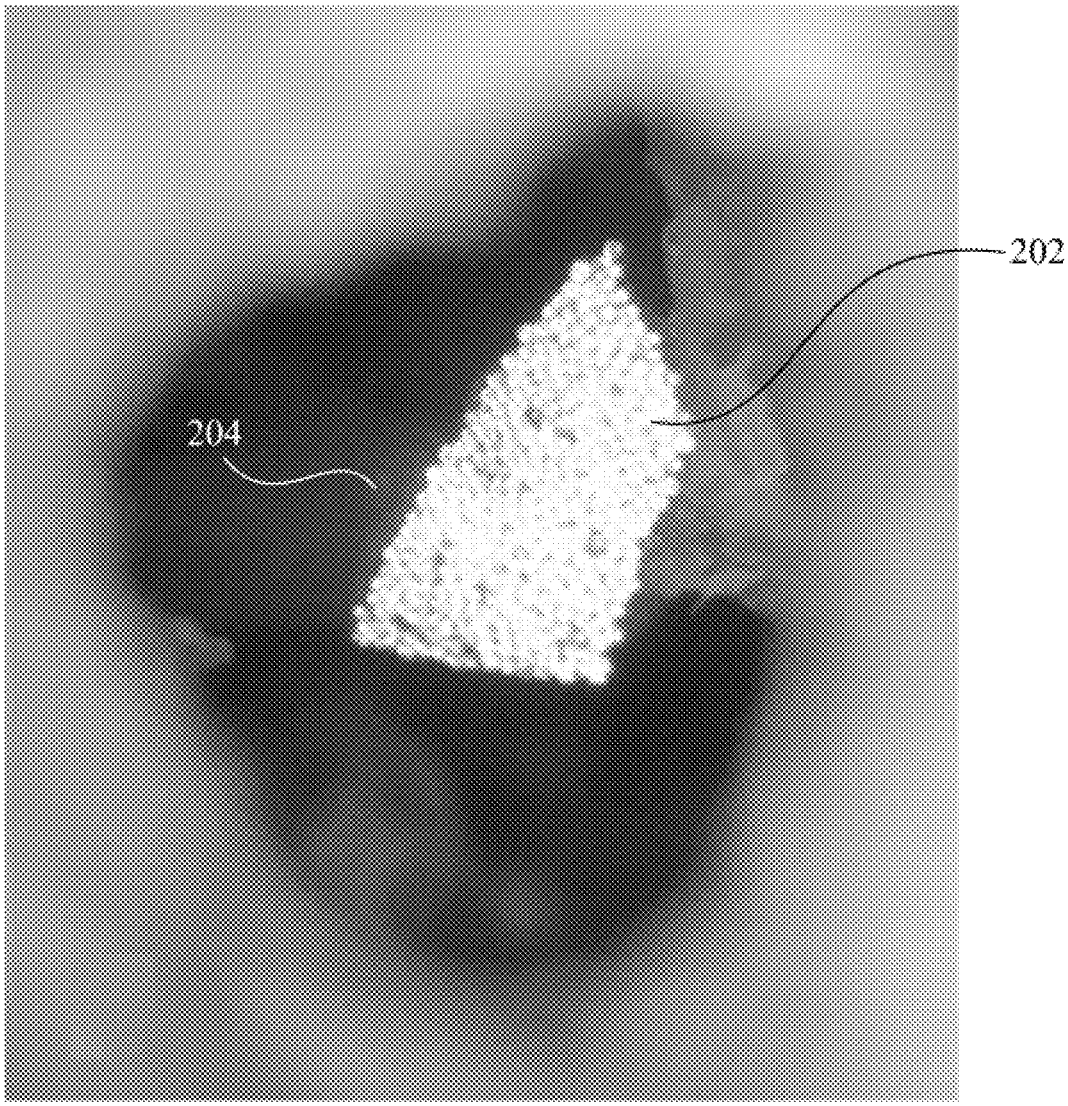
FIG. 2*a* illustrates an example of a small piece of reflective tape placed on posterior crus of stapes.

FIG. 2*a* illustrates an example of a small piece of reflective tape placed on posterior crus of stapes. A small piece of reflective tape 202 was cut and attached to the posterior crus 204 of the stapes to allow for measurements of the stapes displacements. The range of stapes displacements by sound were measured prior to insertion of the tympanostomy tube to serve as a baseline for future comparisons. The sound was delivered through an earphone (Etymotic ER-5A; Elk Grove Village, Ill.) at 70 and 80 dB SPL from 300 to 10,000 Hz. The displacements were measured by a Laser Doppler Vibrometer (LDV [MSA 500; Polytec, Inc.; Irvine, Calif.]) through the reflective tape.

Figure 2B:
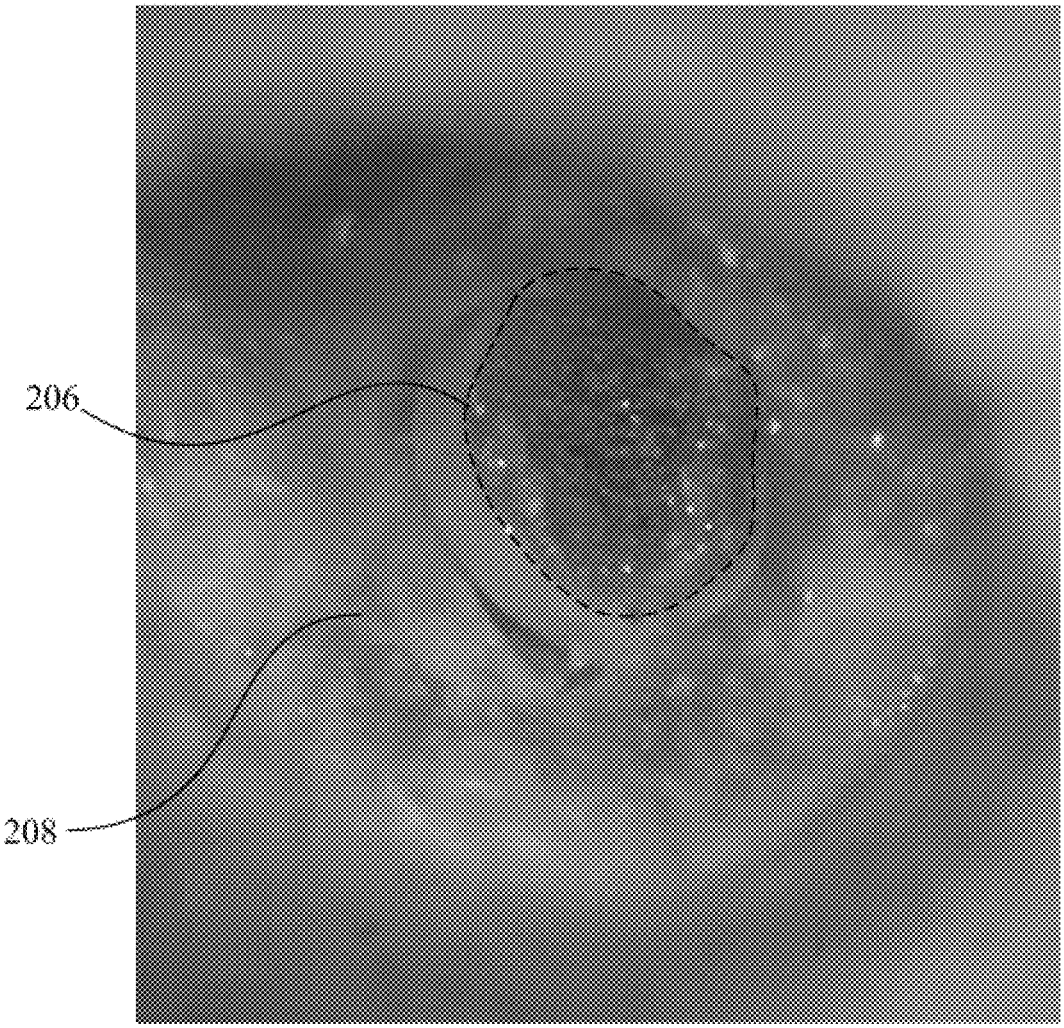
FIG. 2*b* illustrates an example of a tympanostomy tube with ferromagnetic cap sealed inside the tympanic membrane.

FIG. 2*b* illustrates an example of a tympanostomy tube with ferromagnetic cap 206 sealed inside the tympanic membrane 208. The tympanostomy tube used for this study was an Armstrong V Grommet, H/C-Flex® with 1.14 inner diameter and 2.1 mm inner flange diameter (Medtronic Xomed, Jacksonville, Fla.). A mixture of epoxy and nickel powder (3:1) was made (2 mg weight) and glued to the outer flange of the tube. After making an incision in the pars tensa portion of the TM, the ferromagnetic tube was placed and sealed. As shown in FIG. 1, a 5-mg magnet 104 was glued to an 8-mg angled silicone mold 106 that was previously obtained from the TM.

Figure 2C:
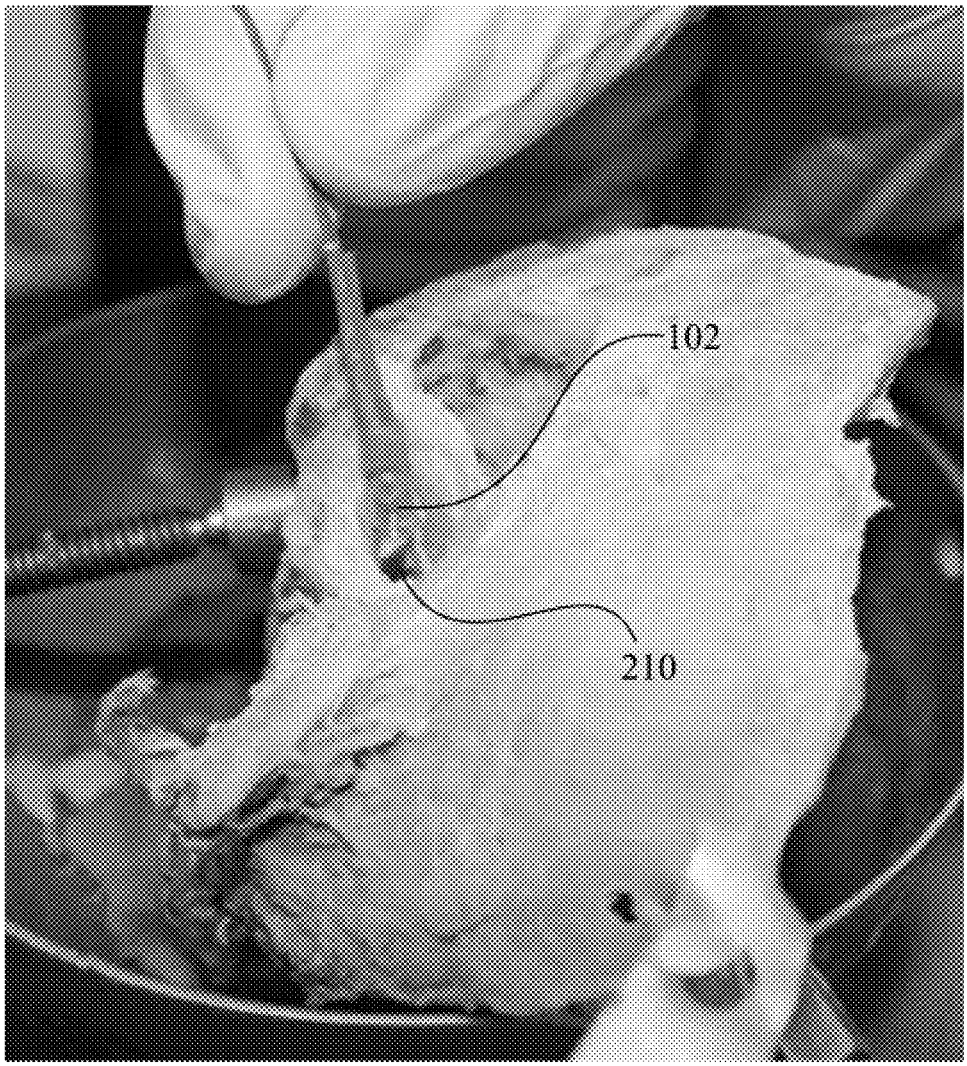
FIG. 2*c* illustrates an example placement of DHD into the ear canal.

FIG. 2*c* illustrates an example placement of DHD into the ear canal. After attaching the silicone to the tip of the DHD 102, the device was carefully placed inside the ear canal 210 to contact the tympanostomy tube, and was fixed with bone wax. A small opening was made into the wax to allow for ear canal ventilation.

Figure 3:
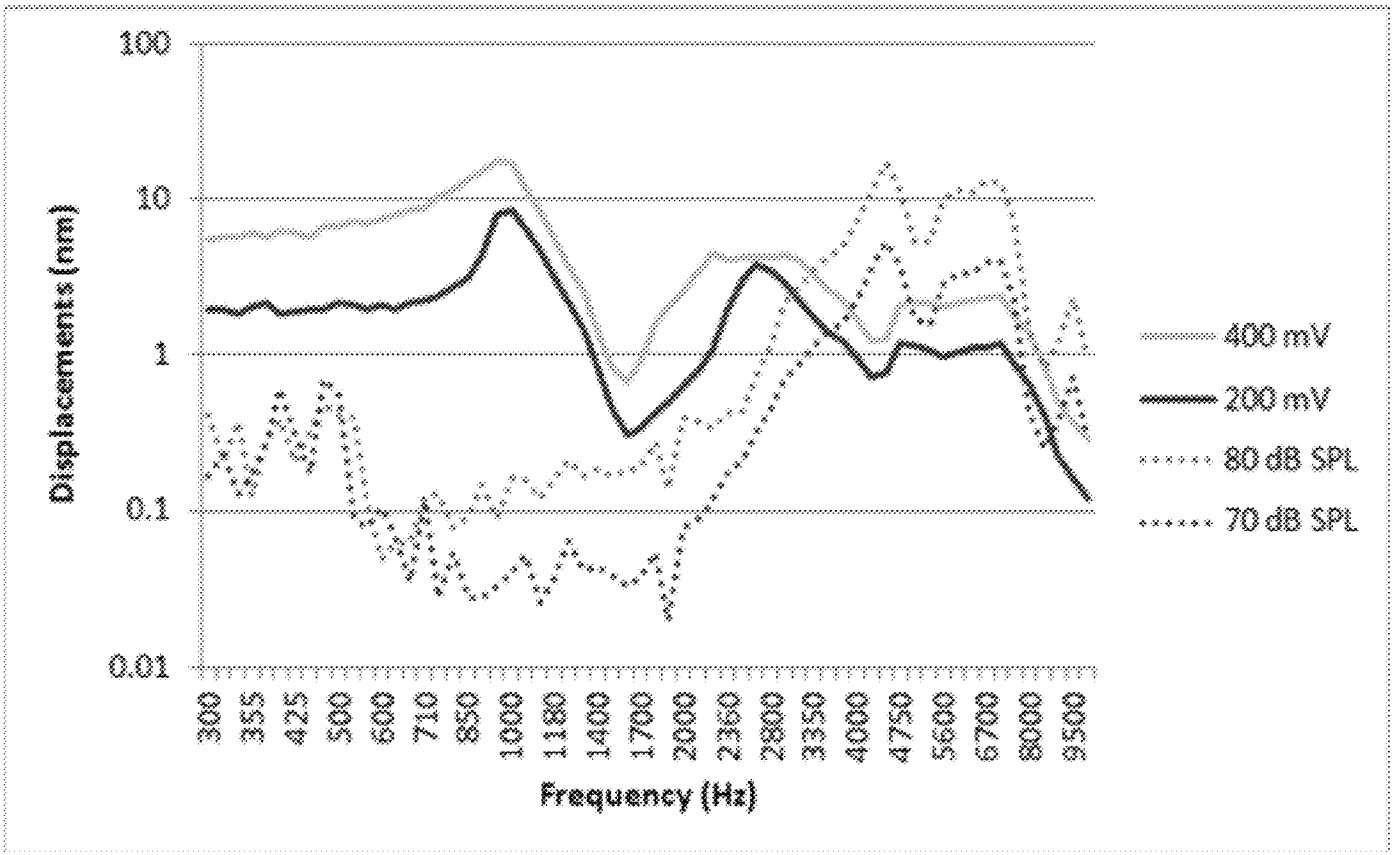
FIG. 3 illustrates displacements of posterior crus of stapes in response to various frequencies.

FIG. 3 illustrates displacements of posterior crus of stapes in response to various frequencies. The device was driven by various inputs between 100 and 400 mV at frequencies from 300 to 10,000 Hz and the stapes displacements were recorded. The range of displacements induced by the device was compared to those of natural sound. A cosine correction of 45 degrees was applied to all measurements due to the angle between the measuring angle of LDV and the movement of the stapes.

Results

The bench testing of the uncoupled device revealed that the prototype had a linear frequency response and its noise generation was below the level of background noise. The mean (±standard deviation) displacements of the stapes in response to 70 dB SPL sound was 0.83±1.29 nm (range 0.02-5.40 nm) as shown in FIG. 3. A 200 mV input to the device produced a range of displacements equivalent to those of sound at 70 dB SPL (mean 1.95±1.67 nm; range 0.12-8.61 nm). The mean displacements in response to 80 dB SPL sound was 2.54±4.18 nm (range 0.05-16.89 nm). A 400 mV input produced a range of displacements equivalent to those of sound at 80 dB SPL (mean 4.88±4.04 nm; range 0.28-17.48).

DISCUSSION

The tympanostomy tube with ferromagnetic cap is capable of transmitting the driving force of the DHD onto the middle ear ossicles. We believe that the magnet attached to the device successfully locked with the epoxy-nickel cap and established a stable connection for mechanical actuation of the TM. The inputs ranging 200-400 mV into the device were capable of inducing displacements of the posterior crus equivalent to those of sound at 70 and 80 dB SPL. Therefore, this design could be a potential option for moderate to severe levels of hearing loss. The range of displacements in the current study was also comparable to our prior design readings. Tympanostomy tubes are routinely used in the clinical setting and are well tolerated by patients. This study showed they could also emerge as a viable option for our future device-TM interface in clinical studies.

In some instances, the age of the cadaveric temporal bone may be a limitation. The tympanic membrane and ossicles in older specimens are stiffer than in fresh cadavers or in vivo. However, the measurements of displacements both at baseline and with the device on were performed on the same cadaver to balance for unknown effects.

What is claimed is:

1. A hearing aid apparatus comprising:

a direct-drive hearing device (DHD) having a silicone mold on one end, the silicone mold having an attached driver; and a tympanostomy tube with a ferromagnetic cap, the tympanostomy tube being insertable into a tympanic membrane, wherein the DHD is placeable inside an ear canal such that the driver is in contact with the ferromagnetic cap of the tympanostomy tube and wherein the tympanostomy tube with the ferromagnetic cap is capable of transmitting a driving force of the DHD onto the tympanic membrane.

2. The apparatus of claim 1, wherein the tympanostomy tube provides a mechanical interface with the middle ear.

3. The apparatus of claim 1, wherein a magnet of the DHD locks with the ferromagnetic cap and establishes a stable connection for mechanical actuation of the tympanic membrane.

4. A hearing aid apparatus comprising:

a direct-drive hearing device (DHD) having a silicone mold on one end, the silicone mold having an attached magnet; and a tympanostomy tube with a ferromagnetic cap, the tympanostomy tube being insertable into a tympanic membrane, wherein the DHD is placeable inside an ear canal such that the magnet attached to the silicone mold is in contact with the ferromagnetic cap of the tympanostomy tube and wherein the tympanostomy tube with the ferromagnetic cap is capable of transmitting driving force of the DHD onto middle ear ossicles.

5. The apparatus of claim 4, wherein the magnet of the DHD locks with the ferromagnetic cap and establishes a stable connection for mechanical actuation of the tympanic membrane.

6. The apparatus of claim 4, wherein the tympanostomy tube provides a mechanical interface with the middle ear.

* * * * *